United States Patent [19]

Nakai

[11] Patent Number: 4,885,923

[45] **Date of Patent: * Dec. 12, 1989**

[54] COMBINATION LOCK

[75] Inventor: Hatsuo Nakai, Toyonaka, Japan

[73] Assignee: Clover Co., Ltd., Osaka, Japan

[ * ] Notice: The portion of the term of this patent subsequent to Sep. 13, 2005 has been disclaimed.

[21] Appl. No.: 161,570

[22] Filed: Feb. 29, 1988

[30] Foreign Application Priority Data

Sep. 2, 1987 [JP] Japan ..... 62-219688

[51] Int. Cl.[4] ..... E05B 37/00

[52] U.S. Cl. ..... 70/284; 70/312; 70/316; 70/314

[58] Field of Search ..... 70/284, 285, 312, 314–318

[56] References Cited

U.S. PATENT DOCUMENTS

| | | | |
|---|---|---|---|
| 3,529,454 | 9/1970 | Fish | 70/314 X |
| 3,633,388 | 1/1972 | Atkinson | 70/285 X |
| 4,249,469 | 2/1981 | Craske | 70/312 X |
| 4,290,286 | 9/1981 | Rae | 70/285 |
| 4,499,745 | 2/1985 | Ricouard et al. | 70/285 |
| 4,520,641 | 6/1985 | Bako | 70/316 X |
| 4,671,088 | 6/1987 | Jeang | 70/284 X |
| 4,711,108 | 12/1987 | Garro | 70/312 |
| 4,770,013 | 9/1988 | Nakai | 70/314 X |

*Primary Examiner*—Gary L. Smith
*Assistant Examiner*—Suzanne L. Dino
*Attorney, Agent, or Firm*—Jordan and Hamburg

[57] ABSTRACT

A lock applied to an opening-closing part of a locker for rent or the like includes a combination lock in a movable member of a door or the like with a locking mechanism having a cam plate engaging with and disengaging from a catcher of the main body side and a dial lock for defining operation of the locking mechanism disposed in linkage with this locking mechanism. A mechanism is provided such that the lock-releasing numerals in the dial lock can be arbitrarily set by the user.

9 Claims, 9 Drawing Sheets

COMBINATION LOCK

BACKGROUND OF THE INVENTION

The present invention relates to a locking apparatus applied to lockers for rent and the like including safe deposit boxes and strong boxes, and specifically, the present invention relates to a combination lock wherein a key-operated lock is combined with a dial lock.

Conventionally, for example, locking apparatuses for lockers for rent include the one by means of key operation or the one of the dial type using no key.

Then, in the case of the locking apparatus by means of key operation, accidents have often taken place that the user of a locker loses a key, and this lost key is accidentally picked up or stolen by a malicious person, and articles in the locker are stolen. Or, it might happen that the user of a locker makes a replica key with his key taken as a model and causes an accident of theft using the replica key.

For this reason, in the case of the locker for rent or the like, the locker room needs a manager such as a watchman, and much labors are required for managing lockers and keys.

Also, in the case of the latter dial lock, it has an advantage of requiring no key, while numerals used for releasing lock are determined on a lock basis in advance by the mechanical structure. These numerals used for releasing the lock can be changed by adjusting the mechanical structure inside the lock, but to change the numerals for releasing the lock, the change has to be made every time by operating a lever or pin from the side surface or rear surface of the lock main body. However, in the case of a locker for rent or the like which is always used by many non-specific persons, it is impossible to change the numerals for releasing the lock every time it is used. Also, in the case where the numerals are not changed, there exists a problem that if a stranger memorizes them he can easily release the lock.

SUMMARY OF THE INVENTION

A combination lock in accordance with the present invention consists of a locking mechanism wherein a cam plate is attached in a fixed fashion to a shaft member rotated by a key operation and a dial lock which is disposed in this locking mechanism in a linked fashion and defines operation of the locking mechanism, and provides a mechanism which sets an arbitrary numeral for releasing the lock for each dial of this dial lock.

Therefore, the principal object of the present invention is to provide a novel combination lock which is a combination lock of a locking mechanism of a cam plate system and a dial lock of a mechanical structure, wherein the user of the lock can arbitrarily set numerals used for releasing the lock for each dial in the dial lock, and which exerts an excellent effect as a locking apparatus of a locker for rent or the like utilized by many non-specific persons.

The above-described object, features and effect will become more apparent from the following description made in reference to the accompanying drawings.

DETAILED DESCRIPTION OF THE PREFERRED EMBODIMENTS

Figure 1:
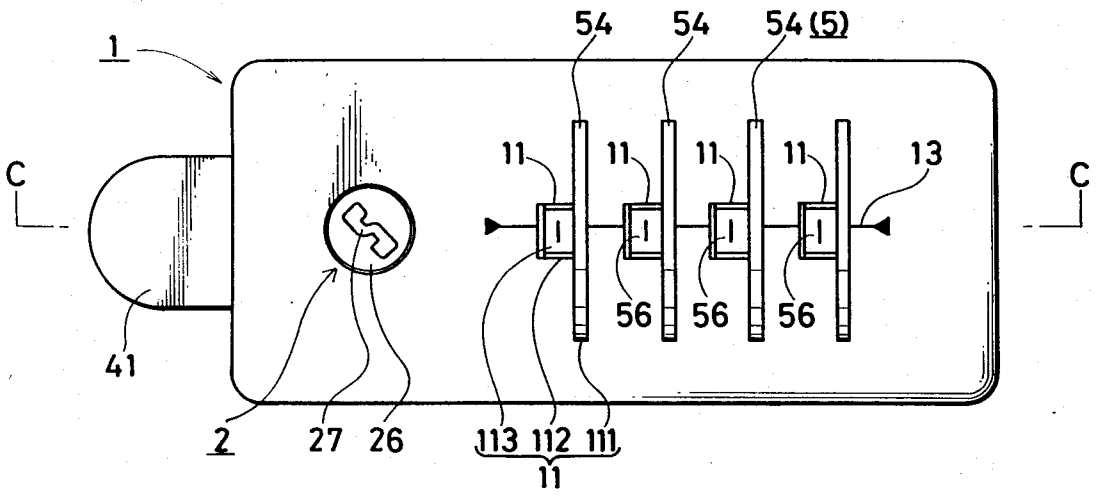
FIG. 1 is a front view of a combination lock of a first accordance with the present invention.
Figure 2:
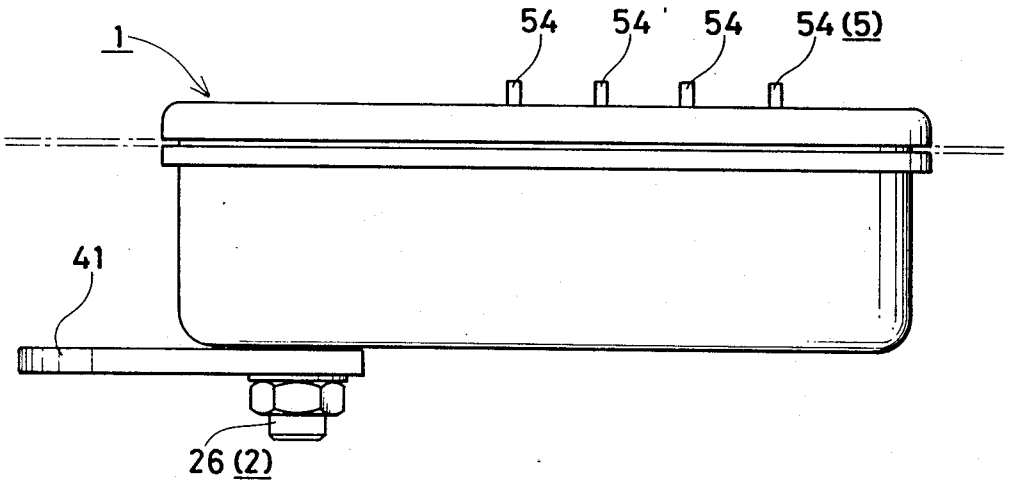
FIG. 2 is a bottom view of FIG. 1.
Figure 3:
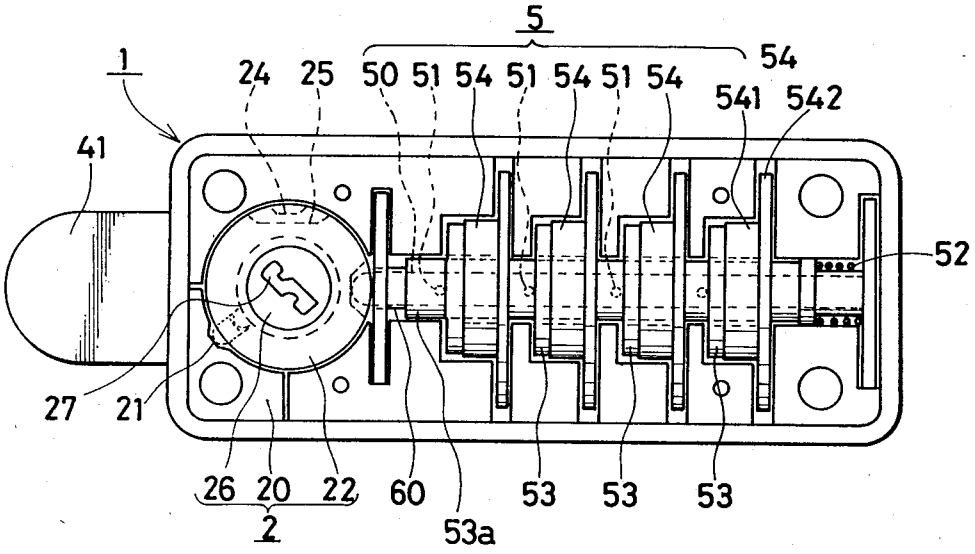
FIG. 3 is a view when locking is performed, showing an inner mechanism.

FIG. 1 shows a combination lock of one embodiment in accordance with the present invention.

This combination lock is constituted inside a housing 1 attached and fixed to the movable side of a door or the like, and consists of a locking mechanism 2 which is disposed in the housing 1 and wherein a cam plate 41 is attached to an inner cylinder 26 rotated by a key operation and a dial lock 5 which is disposed in this locking mechanism 2 in a linked fashion and defines operation of the locking mechanism 2.

The above-mentioned locking mechanism 2 is constituted with a bearing cylinder 20 which is attached and fixed in the housing 1 and has a side bar engaging part 21 on the inner surface thereof, an outer cylinder 22 which is disposed rotatably in this bearing cylinder 20 and has a side bar 38 which engages with and disengages from the above-mentioned engaging part 21, an operating bar 39 which is installed in this outer cylinder 22 and defines movement of the side bar 38, a resetting clutch bar 40 for defining operations of the inner and outer cylinders 26 and 22, a plurality of disc tumblers 31 which are disposed in the inner cylinder 26 opposite to the above-mentioned operating bar 39 and are for defining operation of the operating bar 39 operated by insertion and draw-off of a key, and a plurality of disc tumblers 31b which are disposed in the inner cylinder 26 opposite to the above-mentioned clutch bar and define operation of the clutch bar 40 by operating by insertion and draw-off of a reset key.

Figure 10:
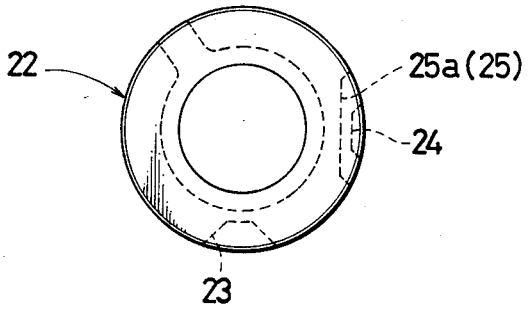
FIG. 10 is a front view of an outer cylinder.
Figure 11:
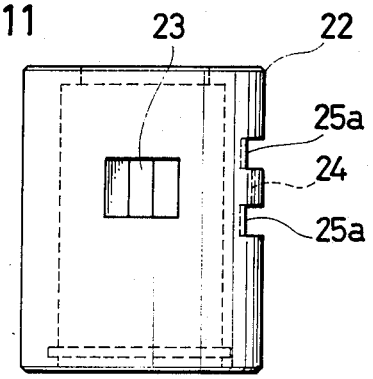
FIG. 11 is a bottom view of FIG. 10.

On the above-mentioned outer cylinder 22, as shown in FIG. 10 and FIG. 11, an engaging part 23 with an operating shaft 50 is formed on the outside surface corresponding to the operating shaft 50 of the dial lock 5 when the cam plate 41 is located at the locking position, and a positioning recession 24 and an operating cam 25 reciprocating a bush in the dial are formed when the cam plate 41 is located at the lock-releasing position, respectively.

Figure 12:
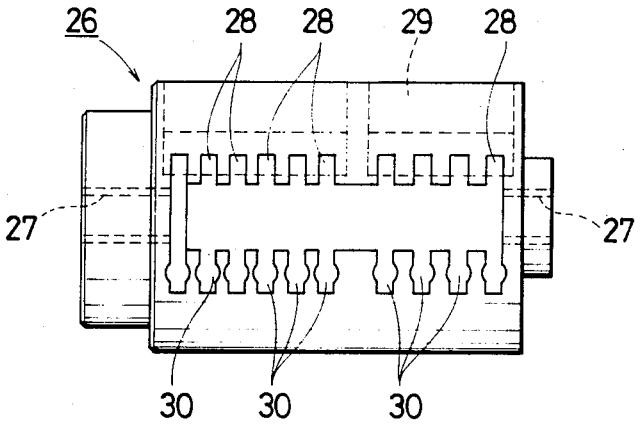
FIG. 12 is a side view of an inner cylinder.

The inner cylinder 26, as shown in FIG. 12, has nearly a cylinder shape, and has a key hole 27 adapted to the cross-section of the key on the front wall, and a slit-shaped disc tumbler engaging grooves 28 which has equal intervals and are orthogonal to the key hole 27 and whose both ends are opened to the both side peripheral surfaces of inner cylinder 26 are formed between the front and rear walls. At one end of each engaging groove 28, an engaging groove 29 with the operating bar and the clutch bar is installed continuously orthogonally to this, and at the other end, a spring engaging part 30 is formed, and a disc tumbler lock 31 and a spring 32 are engaged with the engaging parts 29 and 30, respectively.

The disc tumbler 31 is formed in a flat plate shape having a width adapted to the engaging part 28 and a length shorter by the sliding distance, and is disposed reciprocatably, and on the surface thereof, a slit-shaped key hole 33 agreeing with the cross-section of the key shaft is formed and also a protrusion 34 having a height and angle of inclination which are adapted to the inclined notch of the corresponding key when the key is inserted is formed at a corner part positioned on the diagonal line of this key hole 33.

Also, at the side of the disc tumbler 33 corresponding to the operating bar 39, a recession 35 whereto the end part of the operating bar is adapted is formed in a manner of shifting the position responding to the height of the protrusion 34. Also, at the other side, a spring shoe 36 is formed in an integral fashion, and this spring shoe 36 engages with the spring engaging part 30, supporting one end of a loaded coil spring 37.

Figure 4:
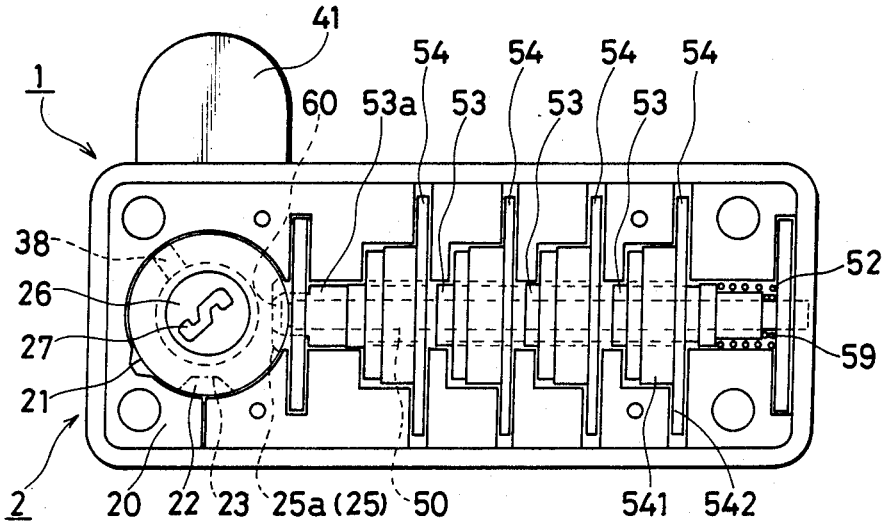
FIG. 4 is a view when lock is released, showing the inner mechanism.
Figure 5:
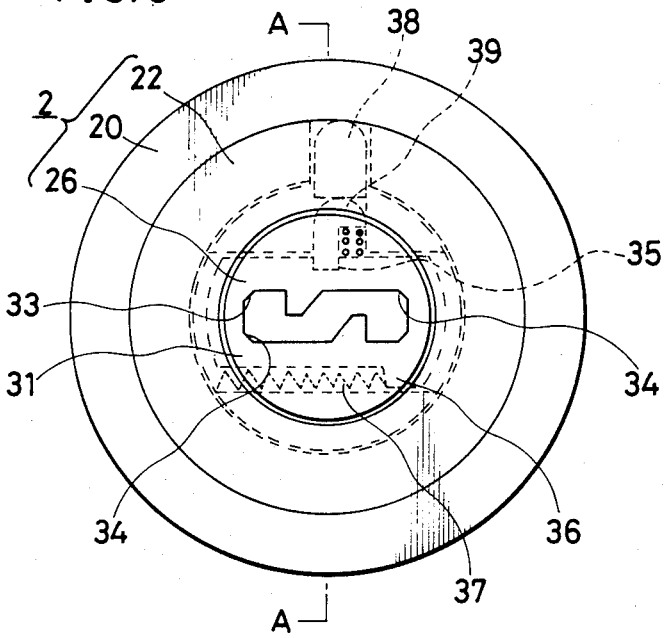
FIG. 5 is a front view of a locking mechanism when lock is released.
Figure 6:
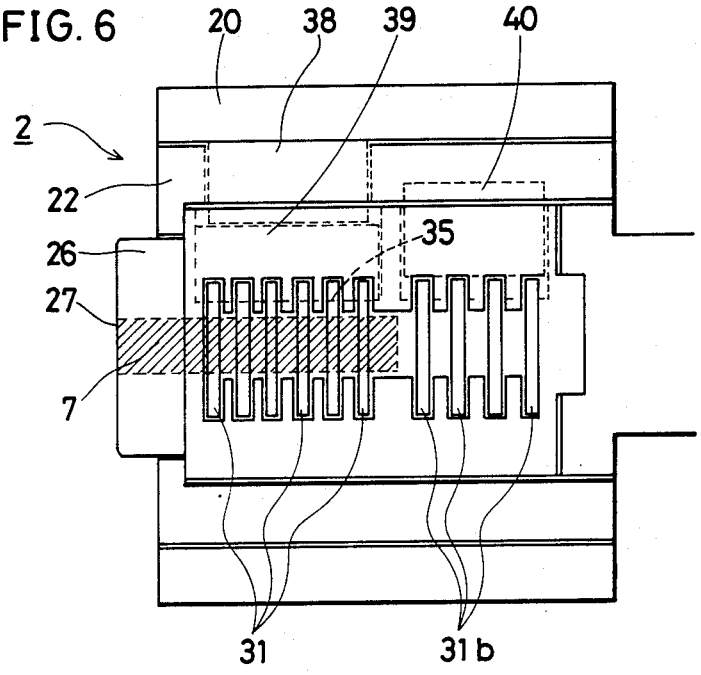
FIG. 6 is a cross-sectional view taken along line A—A in FIG. 5.
Figure 7:
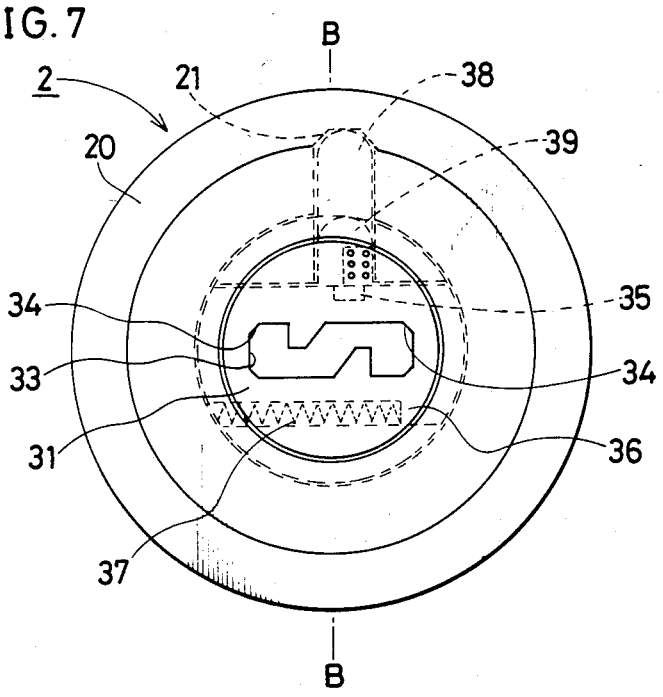
FIG. 7 is a front view of the locking mechanism when locking is performed.

Accordingly, when the cam plate 41 is located at the lock-releasing position, as shown in FIG. 4–FIG. 6, the key is inserted into the inner cylinder 26. At this time, the operating bar 39 engages with the recession 35 of each tumbler 31, allowing movement of the side bar 38, and the side bar 38 is in contact with the inner surface of the bearing cylinder 20. At this time, the clutch bar 40 is supported by the side of each disc tumbler 31, and part of the bar engages with the engaging groove of the outer cylinder 22, and when the key is rotation-operated, the inner and outer cylinders 22 and 26 are rotated through the clutch bar 40. In addition, a disc tumbler 31a corresponding to the clutch bar 40 is the same structure as the above-mentioned tumbler 31, and therefore the description thereof is omitted.

The dial 5 consists of the operating shaft 50 which is disposed reciprocatably in the housing 1 corresponding to the engaging part 23 of the above-mentioned outer cylinder 22 and has a plurality of projections 51 on the side surface of the shaft at equal intervals, a spring 52 energizing the operating shaft 50 by elastic pressure to the locking mechanism side, and a plurality of dials 54 which are journaled rotatably on this operating shaft 50 through bushes 53 and project part of the outer periphery through window holes 11 of the housing 1.

On the bush 53 of each dial 54, one line of projection engaging groove 55 is formed in the axial direction, and on the outer periphery of the dial 54, numerals 56 such as 1, 2 and 3 are displayed, and any one of the numerals 56 corresponds to the projection engaging groove 55. The operating shaft 50 is constituted so as to slide by forward and reverse rotation of the outer cylinder 22 caused by locking and releasing of the cam plate 41 when the projection engaging groove 55 of each dial 54 corresponds to the projection 51 on the shaft.

In the bearing hole parts of the above-mentioned each dial 54 and each bush 53, convex lines 57 and concave grooves 58 whose numbers agree with the number of numerals 56 of the dial periphery are formed, the adjoining bushes 53 butt against each other on the end surfaces thereof, and pressure-energizes a spring 59 so that the convex line 57 disengages from the concave groove 58 in a linked manner. On a bush 53a nearest to the locking mechanism 2, an operating piece 60 engaging with the outer cylinder 22 is installed in a protruded fashion, and on the other hand, on the outer cylinder 22, the cam 25 is formed which engages the convex line 57 with the concave groove 58 by pushing the bush 53 against the spring force when the cam plate 41 is located at the locking position, and in reverse allows movement of the bush 53 and disengages the convex line 57 from the concave groove 58 when it is located at the lock-releasing position. Accordingly, when the cam plate 41 is located at the lock-releasing position, the operating shaft 50 engages with the positioning recession 24 of the outer cylinder 22, and the projection 51 on the shaft engages with the projection engaging groove 55 of each bush 53. On the other hand, the operating piece 60 is positioned at a lower part **25*a* of the cam 25, and moves to the outer cylinder 22 side together with each bush 53. Thereby, the engagement of the convex line 57 with the concave groove 58 is released and the dial 54 rotates freely releasing the locking mechanism 2, and when a new numeral of each dial is set at the lock-releasing position, the previous combination of locking numerals is cleared, and new numerals are set as lock-releasing numerals by locking of the locking mechanism 2**.

The above-mentioned combination lock is provided with a means of releasing lock in the case of forgetting the numerals 56 used for releasing lock, in the case of locking wrongly without watching the numerals, in the case of losing the key or the like.

Figure 13:
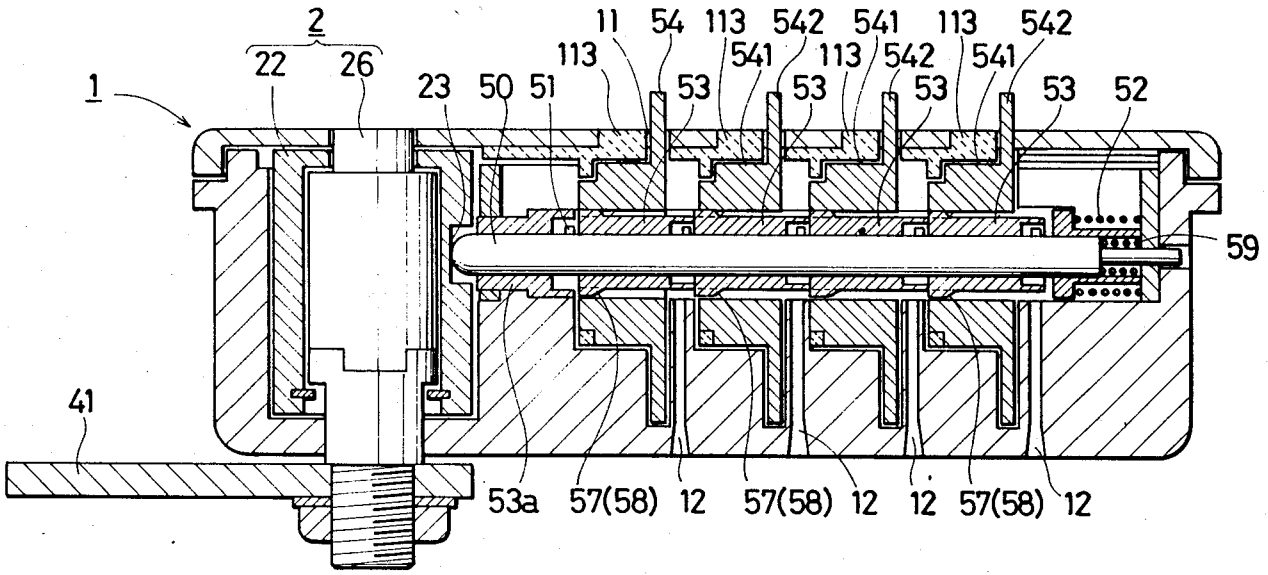
FIG. 13 is a magnified cross-sectional view taken along line C—C in FIG. 1.

This means is provided with guide holes 12 which face the respective bushes 53 and communicate with one another in the rear surface of the housing 1 (FIG. 13), while in each bush 53 a pin hole (not illustrated) facing the guide hole 12 is installed in a concave fashion. Then, the reset key is inserted into the inner cylinder 26 (FIG. 9), and the clutch bar 40 between the inner and outer cylinders is made to retreat from the shear line, and the cam plate 41 is released by operating the key, and thereafter a guide pin such as a wire is inserted through the above-mentioned guide hole 12, and the corresponding dial 54 is rotated, and when the guide pin corresponds to the pin hole, it engages with the pin hole and stops, and the numerals 56 used for releasing lock are positioned on a line 13 at this time, thereby being able to cope with the case of forgetting the numerals or the like.

The dial lock 5 is provided with a defining means which defines the visible range of the numeral on the outer periphery of each dial 56 to the front side of the dial 54.

This defining means is constituted in each dial 54 and the housing 1, and the dial 54 has an operating flange 542 projecting beyond the outer periphery on one side of a dial main body 541 on the outer periphery of which the numerals 56, 1 - 0 are disposed while in the housing 1, slit-shaped window holes 111 whereto the operating flanges are adapted are formed and see-through windows 112 corresponding to one numeral on the outer periphery of the dial main body 541 are formed on one side of each window hole 111 in a series fashion. Part of the operating flange 542 protrudes through the slit-shaped window hole 111 and shields the side of the see-through window 112, and one numeral 56 on the dial main body 541 is positioned inside the see-through window 112, and thereby the visible range of the numeral 56 is defined to the front side of the dial. A transparent plastic plate 113 is fitted to the see-through window 112.

Figure 14:
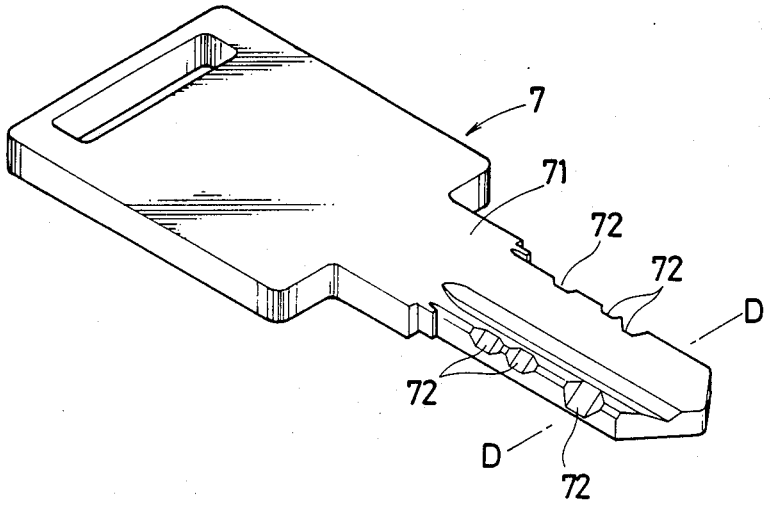
FIG. 14 is a perspective view of a key.
Figure 15:
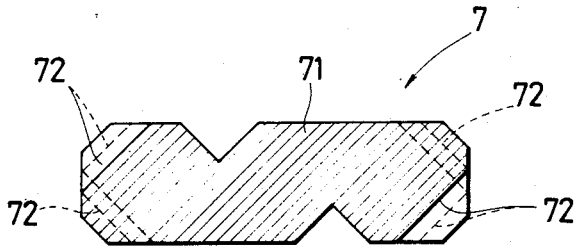
FIG. 15 is a magnified cross-sectional view taken along line D—D in FIG. 14.

As shown in FIG. 14, a key 7 used for a combination lock in accordance with the present invention has a key piece 71 whose shaft cross-section is adapted to the key holes 27 and 34 of the inner cylinder 26 and the disc tumbler 31, and inclined notches 72 are cut up and down alternately with intervals of the disc tumbler 31 kept at the corner parts positioned on the diagonal lines, and the depth of each notch 72 is set to differ so as to match with the protrusion 34 of the corresponding disc tumbler 31.

Next description is made on the operation of the abovementioned embodiment.

Now, when the cam plate 41 is located at the lock-releasing position, the operating shaft 50 of the dial 5 engages with the positioning recession 24 for releasing lock formed on the outer cylinder 22, and each projection 51 on the shaft is positioned in the dial 54. For each bush 53, the operating piece 60 is positioned at the lower part 25*a* of the cam 25, and the convex line 57 disengages from the concave groove 58, and each dial 54 is in the state of free rotation.

Figure 8:
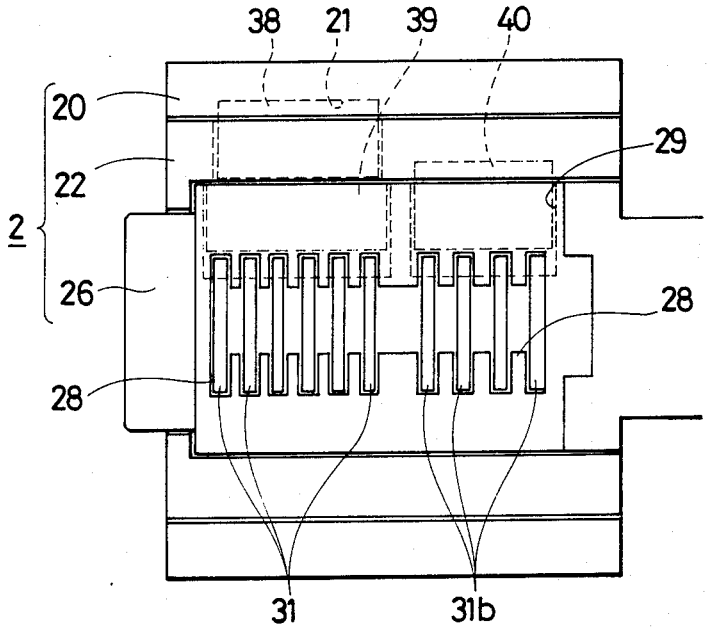
FIG. 8 is a cross-sectional view taken along line B—B in FIG. 7.

On the other hand, the side bar 38 is in contact with the inner surface of the outer cylinder 22, and the clutch bar 40 engages between the inner and outer cylinders (FIG. 6). At this time, arbitrary numerals 56 used for releasing the lock are aligned on the dial stop line 13 of the housing 1. Subsequently, the locking mechanism 2 is rotated by operating the key, and thereby the inner and outer cylinders 26 and 22 including the cam plate 41 are rotated in a one-piece fashion, and the cam plate 41 engages with the catcher of the main body side, and the side bar 38 engages correspondingly with the engaging part of the bearing cylinder 20, and the numeral of each dial is shifted arbitrarily, and thereafter the key is drawn off, thereby the locked state being held (FIG. 8). At this time, the contact part of the side bar 38 with the operating bar 39 is positioned at the shear line between the inner and out cylinders 26 and 22.

In locking, the numerals 56 used for releasing the lock are aligned on the dial stop line 13 of the housing 1, and the proper key 7 is inserted into the locking mechanism 2. Thereby, the projection 51 on the operating shaft 50 and the engaging groove 55 of the bush 53 correspond to each other, and the recession 35 of each disc tumbler 31 is aligned on one line. Thereby, the side bar 38 is disengaged from the engaging part 21 by operating the key and the inner and outer cylinders 26 and 22 are rotated and restored to the original state, and thereby the cam plate 41 is released from the catcher of the main body.

Figure 9:
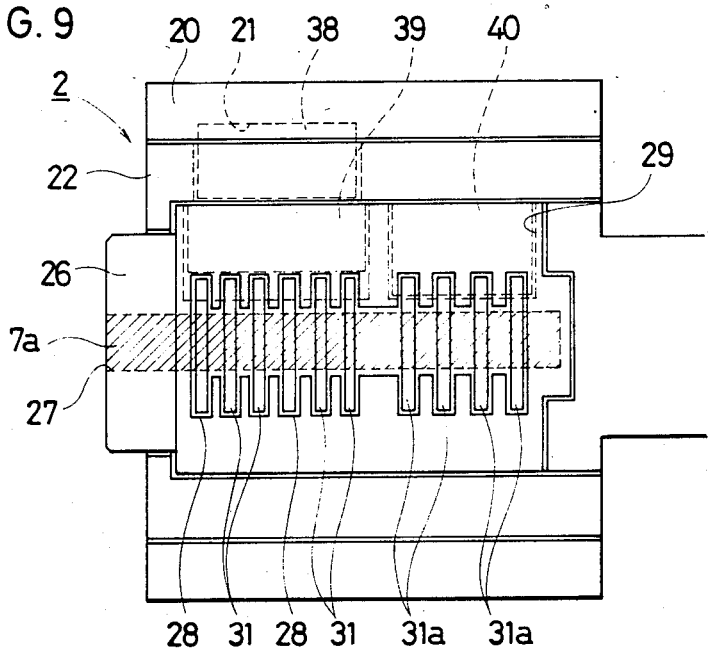
FIG. 9 is an explanatory view of resetting operation.

In the case of losing the key, or in the case of forgetting the numerals 56 used at locking, a reset key 7*a* is inserted into the inner cylinder 26 of the locking mechanism 2 (FIG. 9). At this time, the clutch bar 40 between the inner and outer cylinders 22 and 26 retreats from the shear line, and the inner cylinder 26 including the cam plate 41 is rotated by rotary operation of the key, and thereby the lock is released.

Subsequently, the door is opened and a guide pin such as a wire is inserted through the guide hole 12 on the rear surface of the housing, and the corresponding dial 54 is rotated, and when the guide pin corresponds to the pin hole, it engages with this pin and stops, and the numerals 56 aligned on the line 13 at this time are the numerals having been used at locking, and thus a trouble of forgetting the numerals can be treated.

Hereinbefore, description has been made on the present invention based on the preferred embodiments thereof, and those skilled in the art may perform various modifications and changes therein without departing from the spirit and scope of the present invention as claimed, accordingly the scope of the present invention being limited only by the terms of the appended claims.

What is claimed is:

1. A combination lock comprising a key-operated locking means and a dial lock means, said dial lock means having indicia, operable means on said dial lock means engageable with said key-operated locking means to provide for controlling the operation of said key-operated locking means, said dial lock means having a setting means providing for arbitrarily selecting a setting of said indicia for releasing said dial lock means, whereby said indicia for releasing said combination lock means can arbitrarily be selected and set by the user of the lock, said dial lock means comprising a housing and a plurality of rotatably mounted dial means in said housing, said housing access means in the form of holes in said housing which are adapted to receive a manually inserted external guide tool so that a user of the lock can insert said guide tool in said holes to determine the set combination to open the dial lock means in cases where the set combination is unknown to the user.

2. A combination lock according to claim 1 wherein said dial means comprises a plurality of bushings mounted on a shaft and a dial member mounted on each of said bushings, each of said bushings having a hole for receiving said guide tool to thereby determine said set combination.

3. A combination lock comprising a key-operated locking means and a dial lock means, said dial lock means having indicia, operable means on said dial lock means engageable with said key-operated locking means to provide for controlling the operation of said key-operated locking means, said dial lock means having a setting means providing for arbitrarily selecting a setting of said indicia for releasing said dial lock means, whereby said indicia for releasing said combination lock means can arbitrarily be selected and set by the user of the lock, said key-operated locking means comprising a housing having a bearing cylinder, said bearing cylinder having a recess, an outer cylinder rotatable in said bearing cylinder, said outer cylinder having a side bar means radially movable between an engaged position in which said side bar means is engaged in said recess and a disengaged position in which said side bar means is disengaged from said recess such that when in said engaged position, relative rotation of said outer cylinder in said bearing cylinder is precluded and when in said disengaged position, relative rotation of said outer cylinder in said bearing cylinder is permitted, an inner cylinder rotatable in said outer cylinder, said inner cylinder having an operating bar means aligned with said side bar means and radially movable to provide for said radial movement of said side bar means between said engaged and disengaged positions, said inner cylinder also having a clutch bar means radially movable into and out of engagement with said outer cylinder to respectively preclude and permit relative rotational movement between said inner and outer cylinders, a plurality of first disc tumblers disposed on said inner cylinder juxtaposed to said operating bar means for effecting operation of said side bar means between said engaged and disengaged positions and a plurality of second disc tumblers disposed in said inner cylinder juxtaposed to said clutch bar means for effecting operation of said clutch bar means into and out of engagement with said outer cylinder.

4. A combination lock according to claim 3, wherein said operating bar means has an outer radial position and an inner radial position, said operating bar means being in said outer radial position when said side bar means is in said engaged position, said operating bar means being in said inner radial position when said side bar means is in said disengaged position, said operating bar means when in said outer radial position permitting relative rotation between said inner and outer cylinders.

5. A combination lock according to claim 3 further comprising biasing means on said inner cylinder biasing said operating bar means in an outwardly radial direction.

6. A combination lock according to claim 3, wherein said inner cylinder has a longitudinal axis, said clutch bar means being axially spaced from said operating bar means.

7. A combination lock according to claim 3, wherein said plurality of first disc tumblers are axially spaced from said plurality of second disc tumblers.

8. A combination lock comprising a key-operated locking means and a dial lock means, said dial lock means having indicia, operable means on said dial lock means engageable with said key-operated locking means to provide for controlling the operation of said key-operated locking means, said dial lock means having a setting means providing for arbitrarily selecting a setting of said indicia for releasing said dial lock means, whereby said indicia for releasing said combination lock means can arbitrarily be selected and set by the user of the lock, said dial lock means comprising an axially movable shaft movable to one axial lock position and another axial unlocked position, said key-operated locking means comprising a housing having a bearing cylinder and an outer cylinder rotatable in said bearing cylinder, said outer cylinder having a recess for receiving said shaft when said shaft is in said axial lock position, said dial locking means comprising first biasing means biasing said shaft in a direction to engage said recess, said dial locking means further comprising bushings mounted on said shaft and dials mounted on said bushings, said dials having said indicia, said bushings being axially movable relative to said dials, and second biasing means biasing said bushings in an axial direction toward said outer cylinder, said shaft having radial projections, and said bushings having grooves for receiving said projections such that when said grooves are axially aligned with said projections, said shaft is axially slidable relative to said bushings.

9. A combination lock comprising a key-operated locking means and a dial lock means, said dial lock means having indicia, operable means on said dial lock means engageable with said key-operated locking means to provide for controlling the operation of said key-operated locking means, said dial lock means having a setting means providing for arbitrarily selecting a setting of said indicia for releasing said dial lock means, whereby said indicia for releasing said combination lock means can arbitrarily be selected and set by the user of the lock, said dial lock means comprising an axially movable shaft movable to one axial locked position and another axial unlocked position, said key-operated locking means comprising a housing having a bearing cylinder and an outer cylinder rotatable in said bearing cylinder, said outer cylinder having a recess for receiving said shaft when said shaft is in said axial locked position, said dial locking means comprising first biasing means biasing said shaft in a direction to engage said recess, said dial locking means further comprising bushings mounted on said shaft and dials mounted on said bushings, said dials having said indicia, said bushings being axially movable relative to said dials, and second biasing means biasing said bushings in an axial direction toward said outer cylinder, said key-operated locking means having an outer cylinder having a lock-release position, said outer cylinder also having a positioning recess and a juxtaposed operating cam, said dial lock means having an end bushing slidably mounted on said shaft, said shaft engaging said positioning recess when said outer cylinder is in said lock-release position, said end bushing engaging said operating cam when said outer cylinder is in said lock-release position.

* * * * *